United States Patent [19]

Karpisek

[11] 4,357,736

[45] Nov. 9, 1982

[54] PALLET CAGE HINGE

[76] Inventor: Ladislav S. Karpisek, 86 Woodfield Blvd., Caringbah, N.S.W., Australia

[21] Appl. No.: 265,228

[22] Filed: May 19, 1981

[30] Foreign Application Priority Data

| | | | |
|---|---|---|---|
| May 23, 1980 | [AU] | Australia | PE3702 |
| May 30, 1980 | [AU] | Australia | PE3801 |
| Aug. 27, 1980 | [AU] | Australia | PE5279 |
| Sep. 25, 1980 | [AU] | Australia | PE5746 |
| Dec. 31, 1980 | [AU] | Australia | PE7097 |
| Feb. 3, 1981 | [AU] | Australia | PE7448 |

[51] Int. Cl.[3] ..... E05D 7/10

[52] U.S. Cl. ..... 16/263; 217/57

[58] Field of Search ..... 16/260, 266, 231, 267, 16/263, 380; 217/57, 61

[56] References Cited

U.S. PATENT DOCUMENTS

| | | | |
|---|---|---|---|
| 3,479,683 | 11/1969 | Hull | 16/263 |
| 3,488,793 | 1/1970 | Turpen | 16/263 |
| 3,610,460 | 10/1971 | Marbelite | 16/266 X |

FOREIGN PATENT DOCUMENTS

| | | | |
|---|---|---|---|
| 503317 | 8/1979 | Australia | 16/263 |

*Primary Examiner*—Werner H. Schroeder
*Assistant Examiner*—Andrew M. Falik
*Attorney, Agent, or Firm*—Emory L. Groff, Jr.

[57] ABSTRACT

A hinge of separable parts comprising a leaf part adapted to be mounted on a door and a pin part adapted to be mounted on a support from which the door is to be swung. The leaf part includes a body with a hooked end of channel form, a lug on one end of the channel remote from the body and a notch in the same end of the channel adjacent the body. The pin part including a pivot pin, a first restraining part to restrain the channel from unhooking from the pin in a first radial direction, a second restraining part at one end of the pin to restrain the channel from unhooking from the pin in a second radial direction, a first stop to limit the rotation of the channel about the pin which when performed results in the second restraining part passing through said notch, and a second stop to prevent axial movement of the channel relative to the pin while the channel traverses a given arc of movement about the pin but allowing the channel to be raised relative to the pin beyond that arc so that the channel can be removed from said pin in said second radial direction over the top of the second restraining part.

9 Claims, 22 Drawing Figures

PALLET CAGE HINGE

This invention relates to improvements in a four sided enclosure adapted to be mounted on a pallet. The combined pallet-enclosure assembly provides a container for objects or substances.

In general terms the enclosure is much the same as that disclosed in our Australian Pat. No. 503317 in which the enclosure comprises two pairs of panels, each pair comprises a fixing panel (adapted to be secured to a pallet) which is hinged to a door panel, and releasable coupling means to couple each door panel to the adjacent fixing panel of the other panel pair. The differences occur in the form of the panels and the hinges provided. Each panel in the present enclosure comprises a frame to which is fixed a sheet of, for example, plywood, whereas in Pat. No. 503317 each panel comprised a frame with wire mesh fixed thereto. The hinges are of special form allowing the panels of each pair to assume certain relationships while enabling the door panel to be easily and quickly disconnected from the fixing panel. Several other differences between the "cage" of Pat. No. 503317 and the "enclosure" of this invention will be dealt with in the detailed description that follows.

There is a need for an enclosure as described above. Pallet mounted cages are best suited for hard objects that will not be damaged or bruised by contact with the wire mesh panels. Wire mesh panels are however unsuitable for articles or products that could be damaged or are of such size that they can escape through the openings in the wire mesh. Rice and powdered milk are two examples of products which could be handled in bulk with benefit in a "cage type" container. To allow this to be done the enclosure of this invention has been developed for use with a pallet so as to provide a container. The use of an open top plastic bag liner has proved very successful for powder and granular materials.

It has been found that panels for the enclosure of a container as proposed must come into close contact at each corner if pockets or plastic are not to be formed where adjacent surfaces on adjacent panels meet. Such pockets would be unsupported and could be easily ruptured or torn and the contents of the liner bag, e.g. rice, would then escape. One particular objective of this invention therefore is to provide a container where the joints at the corner of the enclosure where the sides meet are free from gaps. This is particularly important if it is contemplated to put liquid in plastic liner bags. In the latter case the liner bag would be a closed bag as distinct from liner bags used for powder and granules which are preferred to have an open top.

To achieve the required neat fitting corner arrangements new hinge means have been developed to connect the door panel to a fixing panel. A particular form of locking means is preferred to connect the adjacent door and locking panels of two panel pairs as required to form an enclosure on a pallet, said locking means is also described herein. Several of the features of the pallet cage of our Australian Pat. No. 503317, as modified to provide a container as now proposed, are also described herein.

The hinge allowing the objectives of the invention to be achieved, when generally stated is a hinge of separable parts comprising a leaf part including a body to be mounted on a door and a pin part to be mounted on a support from which the door is to be swung. The leaf part includes a channel shaped hooked end portion to engage around a pivot pin in said pin part. The lower end of the channel is provided with an upstanding lug spaced from the body. A notch is provided in said one end of the channel adjacent the body and said pin part includes a pivot pin. First restraining means is spaced radially from the pivot pin to restrain the channel from movement in a first radial direction away from the pivot pin when hooked therearound and lies between said first restraining means and said pivot pin. Upper stop means is engaged by the upper end of the channel to prevent longitudinal upward movement between the channel and the pivot pin during a first arc of pivotal movement of the leaf part relative to the pin part. Lower stop and support means are at the opposite side of the pivot pin to the upper stop means for engagement by the lug on the channel to limit the amount of pivotal movement of the leaf part relative to the pin part and disengagement thereof and to support the lower end of the channel during at least part of the pivotal movement of the leaf part relative to the pin part. Second restraining means is spaced radially from and adjacent the lower stop means to restrain the channel from movement in a second radial direction and of a height such that it will pass through the notch in the lower end of the channel during pivotal movement of the leaf part relative to the pin part and is of a height such that after said first arc of movement has been completed and the leaf part is raised the channel can be moved in said second direction by passing the lower end of the channel over the top of the second restraining means to separate the channel from the pivot pin.

The invention in its several aspects will now be described with reference to the accompanying drawings in which.

Figure 1:
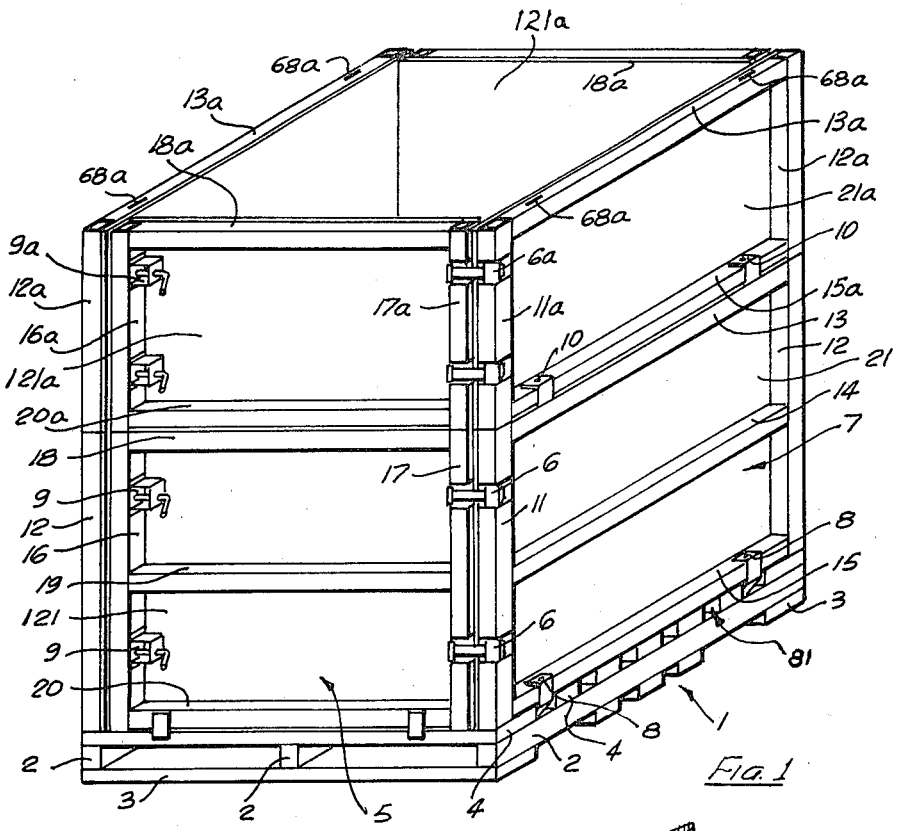
FIG. 1 is a perspective view showing a container, with extension, as proposed by the invention.

In FIG. 1 there is shown a pallet 1 comprised of three bearers 2 with transversely fixed lower battens 3 and upper load supporting battens 4. Secured to the pallet there is a lower enclosure comprised of two pairs of panels each pair comprised of a door panel 5 hinged as at 6 to a fixing panel 7. The fixing panels 7 are secured to the pallet battens 4 by cleats 8, to be described later. Bolts 9 of special form to be described later, couple each door 5 to the fixing panel 7 of the other panel pair.

An upper enclosure is shown mounted on the lower enclosure, simply to give an example of how this can be done. The parts of the upper enclosure have the same numbers as the corresponding parts of the lower enclosure with the additional suffix "a". There are special cleats 10 (to be described) whereby the upper enclosure is coupled to the lower enclosure.

It will be noted that the posts 11–12 and rails 13, 14, 15 of the fixing panels, and the posts 16–17 and rails 18, 19, 20 of the door panels are tubular and square in section. This is desirable but not essential. Fixed to the inside surface of each panel frame there is a sheet of plywood or like material, which has an overall size the same as the panel frame. Internally of the enclosure there is a floor panel 81 and it is larger than the internal size of the enclosure so that at least the lower edges of the sheets 21 and 121 of the four enclosure sides rest thereon to avoid plastic bag pinching gaps between the sheets 21 and 121 and the floor panel 81, which rests on the upper pallet battens. This then is the basic enclosure with the provision for extension to increase its height, as desired.

To ensure the vertical edges of the sheets 21 and 121 of the door panels bear against, or very nearly bear against, the inner faces of the sheets 21 of the locking panels, special hinges 6 and bolts 9 are provided. The hinges 6, as a minimum, allow the door panels to close in a way preventing gaps between sheets 121—121 as described above and open through a first arc of travel where they are prevented from uncoupling from their associated fixing panels but can, when in a second arc of travel, be uncoupled from the fixing panels. It is very desirable that while in the first arc of movement the door panel is positioned so as not to obstruct the opening between the fixing panels mounted on the pallet. This ensures maximum width of access while the door panel is still positively coupled to its fixing panel. It is also desirable that the hinges will allow the door panels to be hinged inwardly, that is opposite to an opening movement, to a position where the sheets 121 of the door and fixing panels will lie in face to face contact. In this way it is possible to fold the door and fixing panels of a panel pair into a face to face relationship for transport or storage in a flat condition while still coupled together. The alternative is to uncouple the door panel from its fixing panel and transport or store the panels in a one on the other relationship. Hinges to allow some or all of the above movements will now be described.

Figure 2:
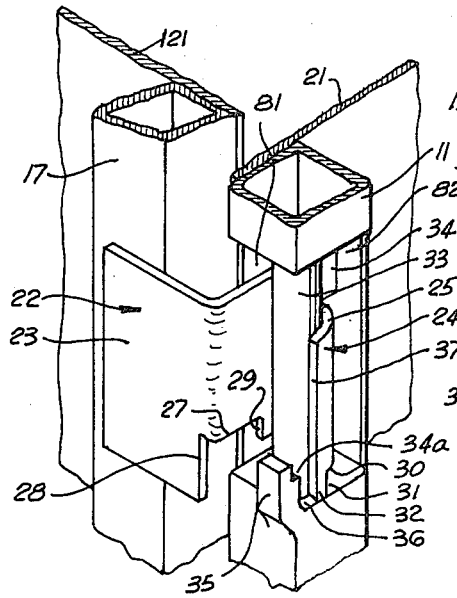
FIG. 2 shows a perspective view of parts of a first form of hinge as proposed by the invention for a door closed condition.
Figure 3:
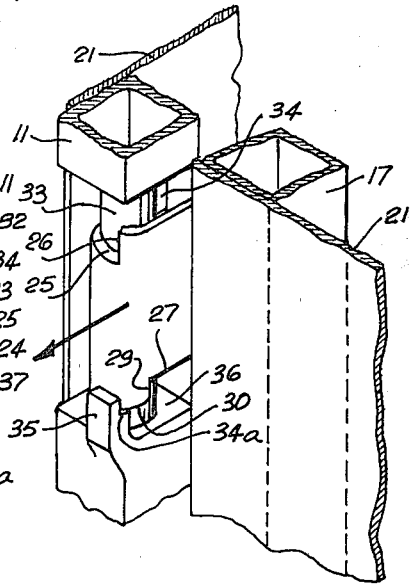
FIG. 3 is a view similar to FIG. 2 showing the parts of the hinge in a door fully open condition.

FIGS. 2 and 3 show one form of hinge to ensure a gapless joint between the end of a door panel sheet 121 and the adjacent inner face of a fixing panel sheet 21 and also permit the door panel to be uncoupled from the fixing panel. As illustrated there is a shaped leaf 22 fixed to the door post 17. It comprises a flat body part 23 and a hooked end 24 which is of U channel form. There is a notch 25 terminating in a shoulder 26 in the upper edge of leaf end 24. There is a notch 27 between shoulders 28 and 29, and a land 30 between shoulder 29 and a shoulder 31 in the lower edge of the leaf end 24. The leaf end 24 is curved to engage around a pin 33 housed in a gap in the fixing panel post 11. The gap is bounded by two side members at 90° to each other. The pin can be in a small housing in which these sides form part and the housing can be secured in the post 11. It will be noted that one of these sides lies in proximity to sheet 21, this side or lugs of appropriate form are required in this location to provide proper hingeing action. The other side member, lying at 90° to the first side member, and therefore at 90° to the sheet 21, is only provided as a strengthening member and is not absolutely necessary for the hingeing function. There is an upper lug 34 and a lower lug with a support surface **34*a* within the post 11 (or the housing as proposed). Spaced radially from the pin 33 there is a lug 35 which lies adjacent but stands above the support surface 34*a***.

Figure 4:
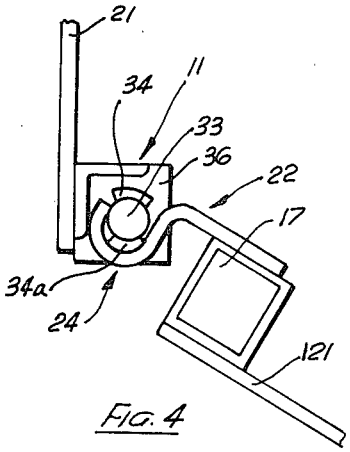
FIG. 4 illustrates a hinge operation when not fitted with features of the FIG. 2 and FIG. 3 construction.

FIG. 2 shows the hinge in a closed position and it will be noted that the leaf-post arrangement 22–27 cannot rise because the surface 25 lies beneath the upper lug 34 with the shoulder 26 in close proximity to a side of the lug 34 to act as a stop to hingeing movement in one direction. While this is a desirable arrangement shoulder 26 need not be present and the surface 25 can in fact be the upper terminating end of the leaf. The weight of the door panel is supported through tongue 32 on the surface 36. As the door panel opens the upper end of the lug 35 passes through notch 27 and the land 30 moves on to the top of the support surface **34*a*. Continued opening movement of the door panel brings the end 37 of the part 24 beyond the lug 34. The overlapping relationship of the lug 34 and the leaf to this time prevented the leaf from being raised. If the leaf is now raised it can be removed in the direction of the arrow to pass the land 30 over the top of lug 35. FIG. 4 illustrates how jamming can occur if lug 35 is not provided. It follows from the foregoing that for a set arc of opening travel the door panel cannot be uncoupled from the fixing panel. FIG. 2 shows how the door sheet 21 edge engages the faces of fixing panel sheet 21. The extent of opening movement is limited by shoulder 31 engaging the lug having the surface 34*a***. The door can be hinged to and fro and not uncoupled, the uncoupling operation requiring the door panel to be raised as a specific operation, as hereinbefore described.

In another configuration, the foregoing arrangement is modified in that the connection of the leaf 22 to the post 17 involves a mechanism to permit rotation of the post 17 relative to the leaf 22 in order to achieve face-to-face relationship between the sheets 21 and 121 of the door and fixing panels. To achieve this there must be combined lateral and rotational motion between the post 17 and the leaf 22. This is achieved in the following manner, having regard to FIG. 5. Located within the post 17 there is an assembly which comprises a leaf extension 37 having an upper notch to provide face 38 and a lower notch to provide face 39. There is an upwardly extending bent leg 40 and a downwardly extending straight leg 41 the same width as the leg 40. The extension 37 terminates in a tongue part 42 with upper an lower faces 43 and 44. The spacing apart of the faces 43 and 44, and the spacing apart of the faces 38 and 39 is the same. The leaf extension is housed in a cam track member 45 of U shape which is part of an assembly fixed in an opening in the post 17. The leg 46 of the member 45 is notched at 47 to provide shoulders 48 and 49. The other U leg 50 and part of the base of the U is removed to provide a transverse surface 51 which terminates with an upright surface 52. The heights of the surfaces 51 and 49 from the base 53 of the cam track member 45 are the same.

Opposite the surface 51 there is a cam track 54 ending in a drop face 55 terminating in a shoulder 56 level with shoulder 48. The peak 57 of the cam is spaced from the face 51 by a distance approximating but greater than the distance between the faces 38 and 39. Fixed to the extension of the U leg 46 there is a spring bracket 58 with a hole 59. The leg 40 has a hole 60 and a spring 61 has its ends entered into the holes 59 and 60 so as to bias the leaf 22 upwardly relative to the cam track member 45.

Figure 5:
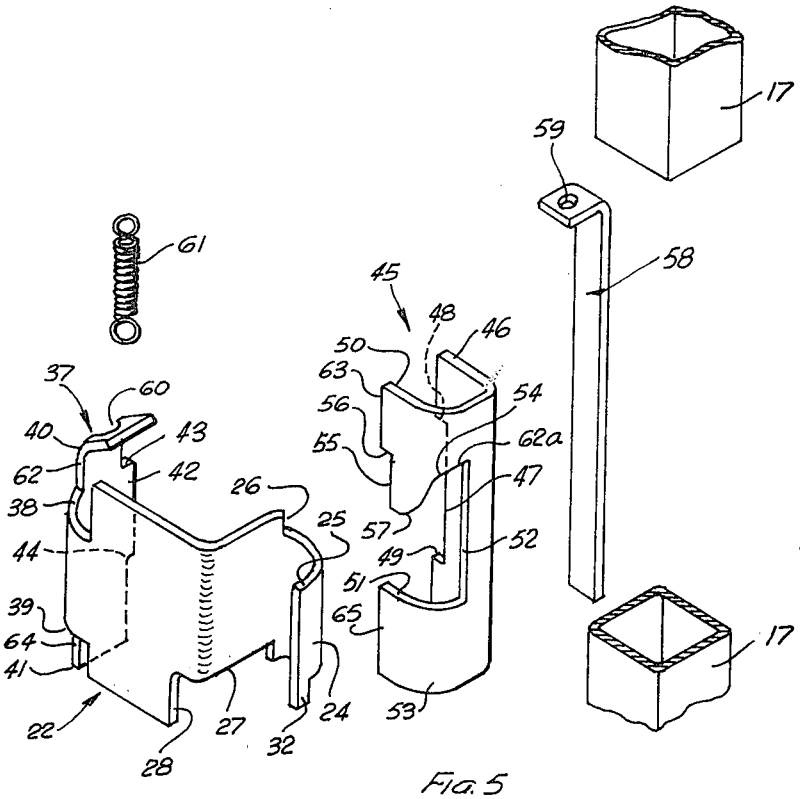
FIG. 5 is a perspective exploded view of the parts of another form of the FIG. 2 and FIG. 3 hinge allowing additional hingeing operations to be carried out such as adopting a door fold back condition.
Figure 6:
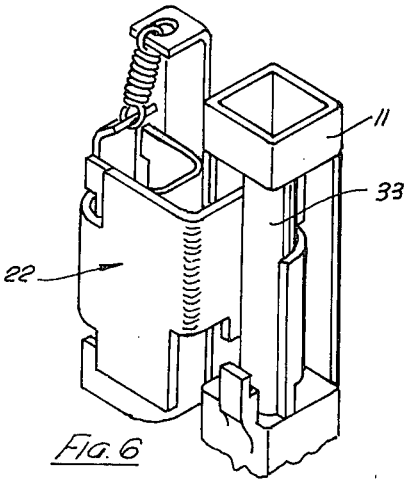
FIG. 6 is a view of the FIG. 5 hinge in door closed condition.
Figure 7:
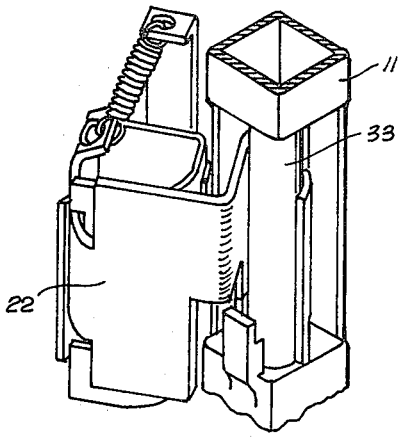
FIG. 7 is a view of the FIG. 5 hinge in a door opening operation.
Figure 8:
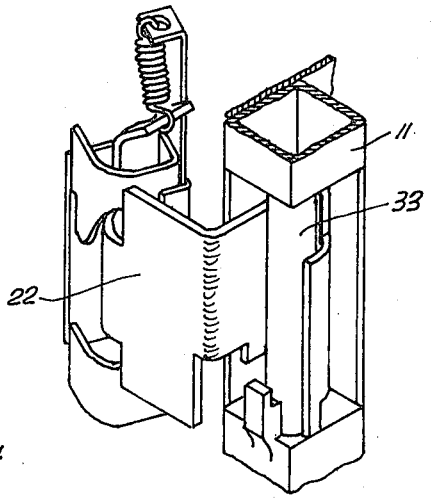
FIG. 8 is a view of the FIG. 5 hinge in a door fold back operation.
Figure 9:
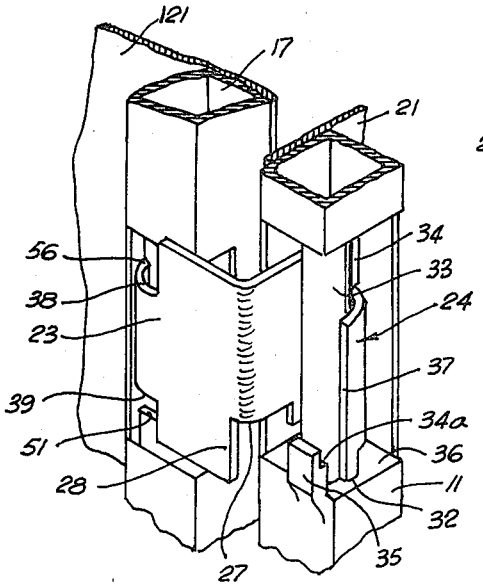
FIG. 9 is a view similar to FIGS. 2 and 3 showing the FIG. 5 hinge.

As assembled the arrangement for the door panel closed condition is as shown in FIG. 6. The door panel swing-open condition is shown in FIG. 7. The door panel fold-back position is shown in FIG. 8. In each case the pin 33 and some of the hinge members are shown, sometimes in broken outline, to give a better understanding. From the FIGS. 5 to 8 it will be understood that the mechanism of FIG. 5 remains locked with the side 62 of the leg 40 behind part 63 and side 64 of leg 41 behind part 65 of the cam track member 45. In this configuration the operation of the hinge is the same as described with reference to FIGS. 2, 3 and 4. When the door fold back configuration is required it is raised relative to the fixing panel to position the face 39 below the peak 59 of the cam. Door panel post 17 can now be turned relative to the leaf 22 until a rest position is achieved where face 39 sits in the end part **62*a* of the cam track, into which it is urged by spring 61 when the effort used to lift the door panel is released. At this time the sheets 121 and 21 attached to posts 17 and 11 will be in edge-to-face relationship. To re-position the post 17 relative to the leaf 22 to allow normal door operation, the reverse rotation is applied, i.e. the door panel is rotated relative to the leaf 22 until the face 39, which is helf on the cam face by spring 61, drops off peak 59 and down the dropped face 55 to rest on the shoulder 56 against which it is urged by the spring 61. It is to be noted that shoulder 56 and the end part 62 of the cam track are at the same elevation, this ensures that when the door panel overlies the fixing panel the rails 13 and 18** are aligned.

Figure 10:
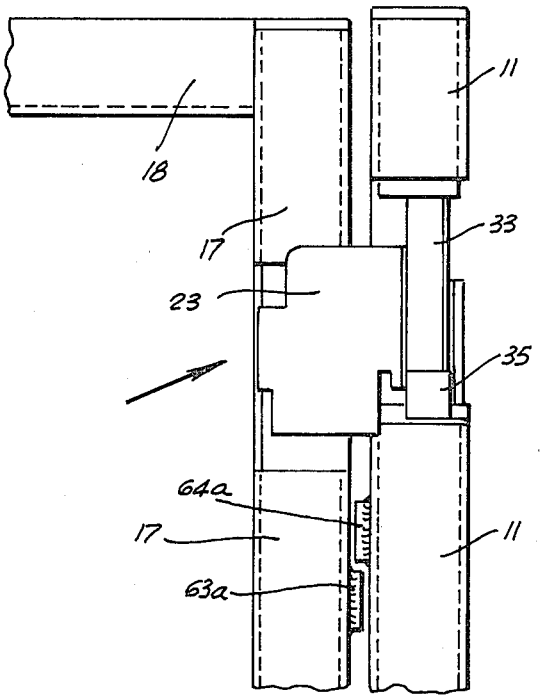
FIG. 10 is a view of the FIG. 5 hinge showing security provision to prevent accidental door fold back manipulation.
Figure 11:
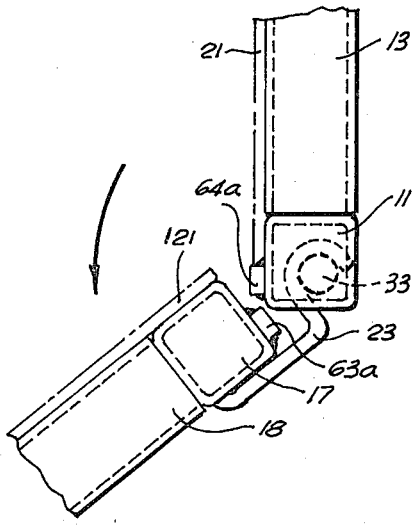
FIG. 11 is a view from above of the FIG. 10 arrangement with the door partly open showing how the door fold back manipulation can be achieved.

An improper relationship can occur between the hinge components in post 17 if the door panel is raised whilst closed. To prevent this two lugs **63*a* and 64*a* are fixed to the posts 17 and 11 as shown in FIG. 10. The lugs prevent the door panel being raised until it is in a part open position, see FIG. 11, and it is only after this position has been achieved that a fold-back manipulation of the hinge parts in post 17** can be undertaken.

Figure 12:
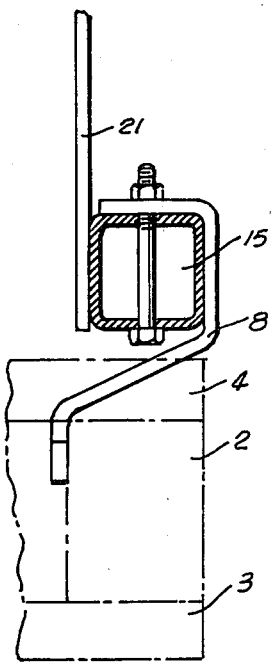
FIG. 12 is a sectional end view of improved cleat means to secure panels to a pallet.
Figure 13:
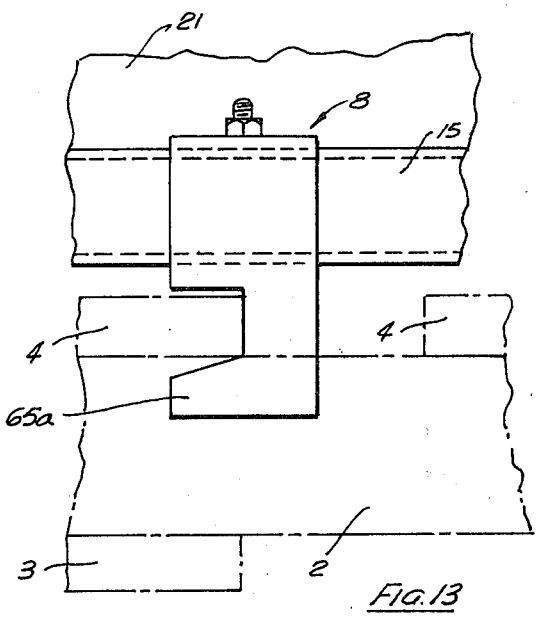
FIG. 13 is a side view of the FIG. 12 arrangement showing further detail.
Figure 14:
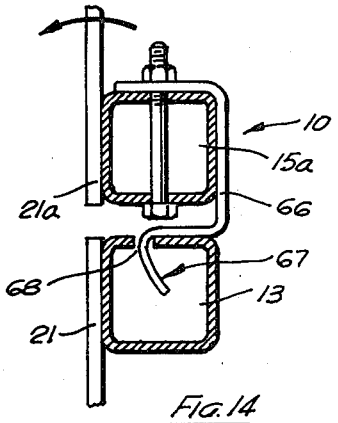
FIG. 14 is a sectional end view of improved cleat means to enable one panel to be secured to the top of another.
Figure 15:
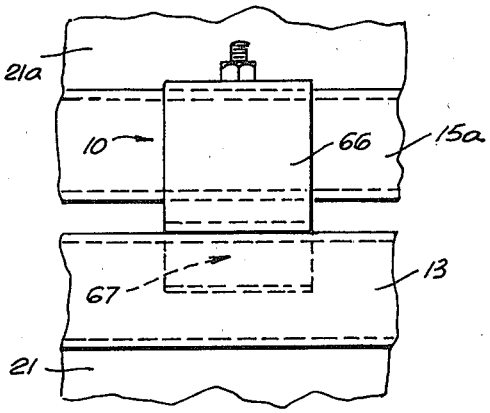
FIG. 15 is a side view showing further detail of the FIG. 14 arrangement.

Other aspects of the container of the invention will now be described. Referring to FIGS. 1, 12 and 13 the preferred cleats to hold the fixing panels to the pallet battens 4 are indicated 8. They are bolted to the rails 15 and their function can be readily seen with lugs 65 engaged under battens 4. The cleats 10 to hold upper fixing panels to the lower fixing panels are as shown in FIGS. 14 and 15 and include body part 66 with curled legs 67 which can only be engaged in slots 68 in the top of the upper fixing panel rail 13, by approaching the insertion of the legs 67 into the slot 68 with the fixing panel outwardly upwardly inclined and then rotating it in the direction of the arrow. It will be observed that this provides a hooked inter-engagement so that if a vertical lift is applied to the upper enclosure it will not separate from the lower enclosure.

Figure 16:
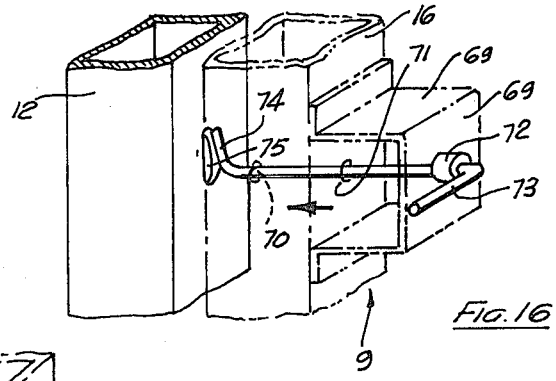
FIG. 16 is perspective schematic view of locking means to secure a door panel to a fixing panel.
Figure 17:
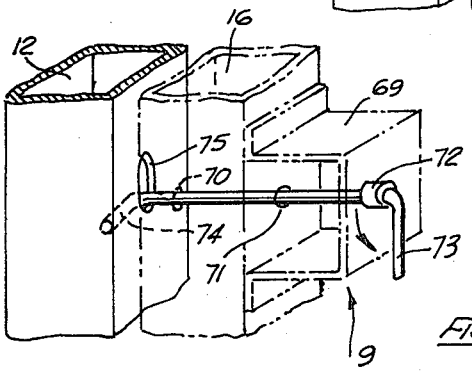
FIG. 17 is a view similar to FIG. 16 showing the locking means of FIG. 16 operated.

The preferred arrangement to lock the door panels closed are upper and lower bolt means 9. From FIGS. 16 and 17 the form of these can be seen. There is a saddle member 69 fixed to the post 16 and aligned holes 70, 71 and 72 in opposite sides of the post 16 and the saddle 69 support a rod which is bent over at one end to form a handle 73 and is bent at the other end, at an angle, to form a cam finger 74, so shaped that it will enter into slot 75 of the post 12 and when turned will by a cam action draw the posts 12 and 16 together. This operation draws the edge of the sheet 121 on the locking edge of the door panel into contact with the inner face of the sheet 21 on the co-operating fixing panel.

Figure 18:
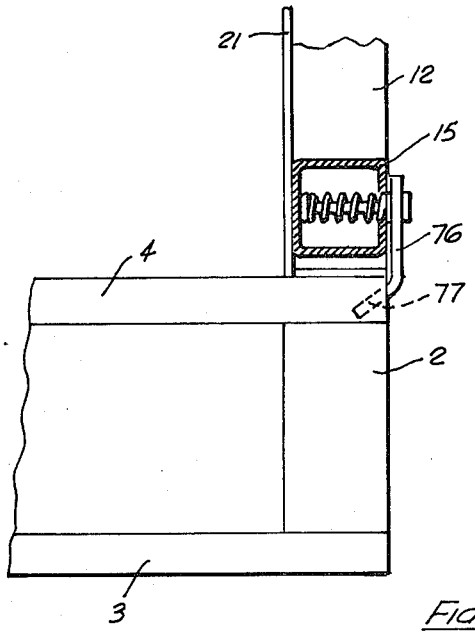
FIG. 18 is a sectional end view of a safety clip to retain cleats below battens.
Figure 19:
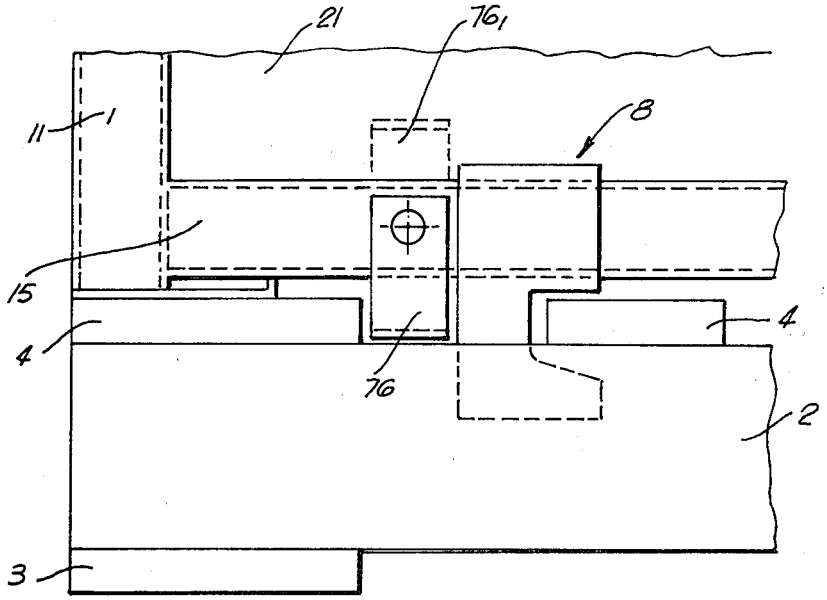
FIG. 19 is a side view of the FIG. 18 construction.

For simplicity in mounting it is preferred to have the lugs 65 of the cleats 8, which can be under any of the battens 4, facing in the same direction. This however presents a problem in that the panel can be moved rearwards and the cleats would then become disengaged from the battens. To prevent this there is provided a spacer 76, see FIGS. 18 and 19, with a bent end 77 spring mounted to the rail 15 in proximity to the cleat 8. After the cleats are engaged under the battens the spacer is rotated from the raised position (shown dotted) to the operative position, shown in full lines in FIG. 19, so that the bent end 77 is located between the cleat and a batten. This effectively prevents rearward movement of the fixing panel.

Figure 20:
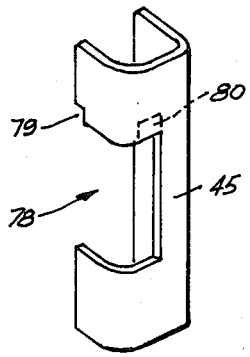
FIGS. 20 to 22 show variations of a cam track member.
Figure 21:
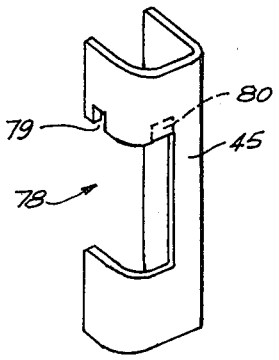
Figure 22:
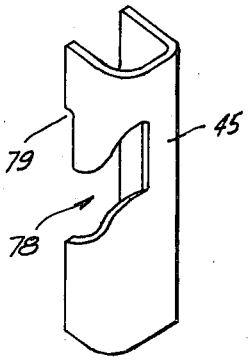

The foregoing are descriptions of preferred arrangements. The hinge can be of much simpler form than described and while it will still function adequately the preferred arrangements have operational advantages. Several variations of the hinge components will now be described. Referring to FIGS. 20, 21 and 22 where views of the cam track member 45 are shown. This member need not have a cam track and therefore member 45 can be considered as a housing for extension 37. In FIG. 20 there is a slot 78 with a notch 79. The disadvantage of this arrangement is that the door panel in the fold-back configuration is not held in place. This is overcome by providing the depression so shown in dotted lines. A variation of this is shown in FIG. 21. FIG. 22 shows a double cam faced slot 78.

Referring to FIG. 5, it will be also understood that the spring 61 is optional as one of the shoulders 43 and 44. The engagement of shoulders 43 and 48 merely complement the engagement of shoulder 56 with face 39 to equalise the load of the door panel acting downwardly on the extension 37.

From the foregoing the several aspects of the invention will be readily understood. The objectives, namely, an enclosure made up from two pairs of panels joined by hinge means to permit required configurations to be achieved have been described. The objective of opening the door panel so as not to obstruct the gap between the fixing panels is achieved by having the pivot pin 33 located outside the gap, see FIG. 11 where this is readily seen. The objective of folding back the door panel, to overlie a fixing panel can be readily seen in FIG. 8 when considered with the written description. Likewise the removal of the door panel is clear from FIG. 3 and the related description. The objective of tight engagement of the end of sheet 121 on the door panel with the inner face of the sheet 21 of the fixing panel is a function not only of the hinge form but, as will be understood, dimensioning and to achieve this objective the length of members, such as the leaf body between parts 24 and 37, must be related to the size of the posts 11 and 17 and the location of the axis of the pin 33.

I claim:

1. A hinge of separable parts comprising a leaf part including a body to be mounted on a door and a pin part to be mounted on a support from which the door is to be swung, the leaf part having a hooked end portion to provide extended engagement with a pivot pin in said pin part; characterized by a lug upstanding from one end (the lower end) of said hooked portion and spaced from the body and a notch in said one end of the hooked portion adjacent the body, said pin part including a pivot pin, first restraining means spaced radially from the pivot pin to restrain the hooked portion from radial disengagement in a first direction from the pivot pin when hooked therearound, and lying between said first restraining means and said pivot pin, upper stop means to be engaged by the other end (the upper end) of the hooked portion to prevent longitudinal upward movement between the hooked portion and the pivot pin during a first arc of pivotal movement of the leaf part relative to the pin part, lower stop and support means at the opposite side of the pivot pin to the upper stop means to be engaged by the lug on the hooked portion to limit the amount of pivotal movement of the leaf part relative to the pin part in a door opening operation and to support the lower end of the hooked portion during at least part of the pivotal movement of the leaf part relative to the pin part, second restraining means spaced radially from and adjacent to the lower stop means to restrain the hooked portion from radial movement in a second direction and of a height such that it will pass through the notch in the lower end of the hooked portion during pivotal movement of the leaf part relative to the pin part and of a height such that after said first arc of movement has been completed and the leaf part is raised the hooked portion can be moved in said second direction by passing the lower end of the hooked portion over the top of the second restraining means to separate the hooked portion from the pivot pin.

2. A hinge as claimed in claim 1 characterized by the leaf part body being mounted movably in a support assembly to be mounted on a door, said support assembly comprising a housing with a slot in a wall of the housing extending part way around the periphery of the housing, one edge (the upper edge) of the slot including a notch said leaf part body having an extension leg extending from the end of the body opposite the hooked end with a head on the leg wider than the slot and disposed within the housing with the extension leg extending through said slot, the width of the extension leg approximating but being less than the width of the slot, said leg when engaged in said slot notch preventing movement of the leg along the slot and when removed from the slot notch being slidable along the slot to cause the leaf part body to travel along a curved path to orient the leaf part body approximately 90° from the position it holds when said leg is engaged in said slot notch.

3. A hinge as claimed in claim 2 characterized by the upper edge of the slot including a depressed portion remote from and at the same elevation as the slot notch to arrest said leg when said leaf part body has traversed said curved path.

4. A hinge as claimed in claim 3 characterized by the upper edge of the slot being inclined to the length direction of the slot from a low point at the bottom of said depressed portion to a high point on the upper edge of said slot.

5. A hinge as claimed in any one of claims 2 to 4 characterized by resilient biassing means urging said leg towards said slot upper edge.

6. A hinge as claimed in claim 2 characterized by an extension of said leg projecting beyond said head and an opening in said housing wall which is engaged by said leg extension when said leg is engaged in said slot notch.

7. A hinge as claimed in claim 1 characterized by the leaf part body being fixed to a post of a frame of a door panel and the pin part being mouned in an opening in a post of a frame of a fixing panel with the pivot pin axis parallel to the length axis of the fixing panel post.

8. A hinge as claimed in claim 2 characterized by the support assembly housing being mounted in an opening in a post of a frame of a door panel so that the curved path of movement of the leaf part body is around the length axis of the door panel post, and the pin part being mounted in an opening in a post of a frame of a fixing panel witht the pivot pin axis parallel to the length axis of the fixing panel post.

9. A hinge as claimed in claim 8 characterized by projections on the post of the door panel frame and on the fixing panel frame respectively, the latter being above the former when the door panel frame is in a door closed relationship relative to the fixing panel frame so as to prevent the door panel frame being elevated relative to the fixing panel frame until at least part of a door opening movement has been accomplished.

* * * * *